US005141805A

United States Patent [19]

Nohara et al.

[11] Patent Number: 5,141,805

[45] Date of Patent: Aug. 25, 1992

[54] CUSHION MATERIAL AND METHOD FOR PREPARATION THEREOF

[75] Inventors: Saburo Nohara, Nishinomiya; Yugoro Masuda, Takatsuki, both of Japan

[73] Assignee: Kanebo Ltd., Sumida, Japan

[21] Appl. No.: 441,975

[22] Filed: Nov. 28, 1989

[30] Foreign Application Priority Data

Dec. 1, 1988 [JP] Japan ..... 63-304350

[51] Int. Cl.[5] ..... D02G 3/00; D04H 1/04

[52] U.S. Cl. ..... 428/296; 5/448; 5/459; 428/288; 428/359; 428/361; 428/362; 428/371; 428/398; 428/401

[58] Field of Search ..... 428/359, 370, 361, 371, 428/362, 401, 364, 369, 288, 357, 398, 296; 5/448, 459

[56] References Cited

U.S. PATENT DOCUMENTS

| | | | |
|---|---|---|---|
| 4,068,036 | 1/1978 | Street | 428/296 |
| 4,129,675 | 12/1978 | Scott | 428/288 |
| 4,199,642 | 4/1980 | Cooper et al. | 428/288 |
| 4,281,042 | 7/1981 | Pamm | 428/395 X |
| 4,418,116 | 11/1983 | Scott | 428/296 X |
| 4,668,562 | 5/1987 | Street . | |
| 4,837,067 | 6/1989 | Carey et al. | 428/105 X |
| 4,957,804 | 9/1990 | Hendrix et al. | 428/373 X |

FOREIGN PATENT DOCUMENTS

| | | |
|---|---|---|
| A168225 | 1/1986 | European Pat. Off. . |
| A171806 | 2/1986 | European Pat. Off. . |
| 0275047 | 7/1988 | European Pat. Off. . |
| A275047 | 7/1988 | European Pat. Off. . |
| 2307071 | 11/1978 | France . |
| 31150 | 2/1983 | Japan . |
| 223357 | 10/1987 | Japan . |

OTHER PUBLICATIONS

European Search Report.

*Primary Examiner*—Lorraine T. Kendell

*Attorney, Agent, or Firm*—Morgan & Finnegan

[57] ABSTRACT

The cushion material according to the invention is prepared by mixing (A) polyester fibers having a fineness of 4 to 30 denier and a cut length of 25 to 150 mm with (B) core-sheath type conjugated fibers having a fineness of 2 to 20 denier and a cut length of 25 to 76 mm in a weight ratio of 95~40:5~60, the sheath component of said conjugated fibers having a melting point lower than that of the core component of said conjugated fibers and said polyester fibers with a difference of 30° C. or more. In the cushion material, cubically and continuously interconnected portions of the fibers are adhered by fusion of the sheath portion of the above core-sheath type conjugated fibers.

The cushion material having a thickness of 10 cm or more and a good quality can be stably prepared by combining far-infrared ray or hot air flow heating and steaming in the heat-treatment.

3 Claims, No Drawings

CUSHION MATERIAL AND METHOD FOR PREPARATION THEREOF

BACKGROUND OF THE INVENTION

This invention relates to a cushion material with use of conjugated fibers and a method for the preparation thereof.

Various cushion materials made of polyester fibers have been developed. They are usually prepared by using two types of polyester fibers having different melting points with respect to each other or using core-sheath type conjugated fibers, and heat-treating in a hot air circulating oven to melt the component having a low melting point. However, in this procedure, the hot air is passed through the interior of the webs in the case of a relatively low density not higher than 0.01 g/cm$^2$ and hence unevenness in density occurs to the direction of thickness of the cushion material due to air pressure. On the other hand, in the preparation of a high density cushion material, the hot air is difficult to pass it through so that the thickness of it is restricted. Furthermore, since the heating mechanism is mainly convection and conduction, the loss in energy is disadvantageously high. In Japanese Laid-Open Patent Publication No. 223,357 of 1987, there has been proposed a method for the preparation of a cushion material by using far-infrared ray as the heat source to overcome such disadvantages. In its Examples, a use of core-sheath type conjugated fibers having sheath of a low melting substance is disclosed.

The heating mechanism of this method is radiation and the energy in the long wave region of far-infrared ray is absorbed in the fiber material and causes internal heating by molecular vibration and thus the heat-fusable fibers in the webs are efficiently molten. Hence, it causes no unevenness in density caused by air pressure as seen in the hot air circulating oven and also the process can be carried out at low temperature in a short period to give good workability. However, it has a disadvantage of that, when the web is thick, it is difficult to melt the interior.

Furthermore, Japanese Laid-Open Patent Publication No. 811, 050 of 1983 discloses a product in which the interconnections are fused by melting low-melting fibers with steaming. In this case, the interconnections can be fixed by melting the low-melting fibers without adhesives and resultantly a product having a good cushioning property can be obtained in a relatively stable condition, but it has problems in workability.

Thus, the methods of heat treatment for the preparation of the cushion material have both merits and demerits and they cannot provide voluminous products having no strain by compression set.

The object of the present invention is to provide a voluminous cushion material consisting of polyester fibers, which has a high quality and little strain by compression set so that it can be used as a mat for bed, and a method for the preparation thereof.

The inventors have found that the above object can be attained by using specific conjugated fibers and combining the advantages of far-infrared ray or hot air flow heating and steaming in heating.

SUMMARY OF THE INVENTION

The cushion material according to the invention is prepared by mixing (A) polyester fibers having a fineness of 4 to 30 denier and a cut length of 25 to 150 mm with (B) core-sheath type conjugated fibers having a fineness of 2 to 20 denier and a cut length of 25 to 76 mm in a weight ratio of 95~40:5~60, the sheath component of said conjugated fibers having a melting point lower than that of the core component of said conjugated fibers and said polyester fibers with a difference of 30° C. or more. In the cushion material, cubically and continuously interconnected portions of the fibers are adhered by fusion of the sheath portion of the above core-sheath type conjugated fibers.

The cushion material according to the present invention is prepared by a method comprising the following steps;

mixing (A) polyester fibers having a fineness of 4 to 30 denier and a cut length of 25 to 150 mm with (B) core-sheath type conjugated fibers having a fineness of 2 to 20 denier and a cut length of 25 to 76 mm in a weight ratio of 95~40:5~60 to prepare card webs, the sheath component of said conjugated fibers having a melting point lower than that of the core component of the conjugated fibers and the polyester fibers with a difference of 30° C. or more, adhering temporarily the card webs by heating with far-infrared ray or with a hot air circulating heater to melt the sheath component of the conjugated fibers, laminating the temporarily adhered webs according to the desired density and thickness, feeding the laminated webs in a steam vessel, evacuating the vessel to a pressure not higher than 750 mm Hg, and introducing steam of at least 1 kg/cm$^2$ to the vessel to heat-treat the laminated webs and to mutually adhere each web layers comprised in the laminated webs.

According to the present invention, a cushion material which has a thickness of at least 10 mm and a density of 0.003~0.15 g/cm$^3$, the scattering of the density being not wider than ±5%, can be stably obtained.

DETAILED DESCRIPTION OF THE INVENTION

Among the polyester fibers used as (A), there are included general fibers made of polyethylene terephthalate, polyhexamethylene terephthalate, polytetramethylene terephthalate, poly-1,4-dimethylcyclohexane terephthalate, polyhydrolactone or their copolymerized ester and conjugated fibers prepared by conjugate spinning. Side-by-side type conjugated fibers comprising two polymers having a different heat shrinkage percentage with respect to each other is preferred, because they form spiral crimps to give cubic structure. Especially, hollow yarns having a hollowness of 5 to 30% are preferably used.

As the core-sheath type conjugated fibers (B), conjugated fibers prepared by using common polyester fiber component as the core and low-melting polyester, polyolefin, polyamide or the like as the sheath may be used. However, the difference between the melting points of the core component and sheath component must be at least 30° C.

The sheath of the core-sheath type conjugated fibers (B) is preferably made of a low-melting polyester. Such a polyester is generally obtained as a copolymerized polyester. Among the dicarbozylic acids used for producing the copolymerized polyester, there are exemplified aliphatic carboxylic acids such as adipic acid and sebacic acid, aromatic dicarboxylic acids such as phthalic acid, terephthalic acid, isophthalic acid and naphtalene dicarboxylic acid, alicyclic dicarboxylic acids such as hexahydroterephthalic acid and hexahydroisophthalic acid and the like, and among the diols used for producing the copolymerized polyester, there are exemplified aliphatic diols and alicyclic diols, such as hexanediol, diethylene glycol, polyethylene glycol and paraxylene glycol and the like. Further, an oxyacid such as parahydroxy benzoic acid may be used to produce the copolymelized polyester. As for the polyesters, there are exemplified those prepared by the copolymerization of terephthalic acid and ethylene glycol together with isophthalic acid and 1,6-hexanediol, and the like.

According to the present invention, it is preferred to use hollow conjugated fibers as the main fibers (A) in the cushion material as described above, because the fibers in the web interconnect irregularly and melt-fused with the low-melting component of the core-sheath type conjugated fibers at the interconnections to give a cubic structure and thus a product of very low repeated compression set is prepared.

The present invention can provide a cushion material which has a thickness of not less than 10 mm and a density of 0.003 to 0.15 g/cm$^3$ and the scattering range of density of not wider than ±5% and which cannot be prepared by conventional methods. It is practically prepared by not only using a specified ratio of the core-sheath type conjugated fibers comprising a low-melting component as the sheath for melt-bonding between fibers but also using a special method of heat treatment as follows.

Thus, the cushion material according to the present invention is prepared by a method of laminating and heat treating by two steps in which the fibers (A) and (B) are mixed together and the surface of the resultant card webs is tentatively fused with far-infrared ray or with a hot air circulating oven and then the fused webs are laminated according to the defined density and thickness and the laminate is fed in a steam vessel and the vessel is evacuated to a pressure of 750 mm Hg or less and then steam of at least 1 kg/cm$^2$ is introduced to the vessel to heat-treat the laminate.

By such a method of laminating and heat-treating by two steps, even the inner layer of the cushion material is melt-adhered uniformly and a product of total good feeling and of excellent appearance can be prepared efficiently.

For example, a thick cushion material having a thickness not less than 10 mm, especially not less than 30 mm, can be easily prepared with a desired density, the scattering range of which is within ±5%. Also, a cushion material having a hardness of not lower than 10 g/cm$^2$ can be prepared stably.

In the present invention, other fibers may be mixed as the third component. Also, at least part of the fibers used in the present invention may be replaced by latent-crimping polyester conjugated fibers, antibacterial polyester fibers containing an antibacterial agent such as antibacterial zeolite or flame-retarding fibers.

Especially, in the case an antibacterial agent is milled in the sheath portion of the core-sheath type conjugated fibers (B), the sheath portion is rendered molten by the heat treatment and at the same time the antibacterial agent spreads over the whole cushion material and adheres to it to show high effect.

DETAILED DESCRIPTION OF THE PREFERRED EMBODIMENTS

The following examples serve to illustrate the invention in more detail although the invention is not limited to the examples.

EXAMPLE 1

(A) 80 weight % of hollow conjugated polyester fibers having a hollowness of 16.1% (fineness: 13 denier, cut length: 51 mm, melting point: 257° C.) prepared by conjugating side by side a polyethylene terephthalate having a relative viscosity of 1.37 and a polyethylene terephthalate having a relative viscosity of 1.22 in a ratio of 1:1 and (B) 20 weight % of core-sheath type conjugated fibers (fineness: 4 denier, cut length: 51 mm) containing a polyethylene terephthalate having a melting point of 257° C. as the core and a copolymerized polyester (terephthalic acid/isophthalic acid=60/40) having a melting point of 110° C. as the sheath were mixed together in a hopper feeder and carded and then made into a web having a weight of 350 g/cm$^2$ with a cross layer method. The web was passed through a far-infrared heater at 130° C. continuously to give a melt-adhered web. The resultant web was cut into sheets 1 m wide and 2 m long and 10 sheets of the cut web were laminated and placed between two stainless steel plates and pressed to a thickness of 10 cm and fed in a steam oven. Air in the steam oven (and in the web laminate in it) was evacuated with a vacuum pump to a pressure of 750 mm Hg and then steam of 3 kg/cm$^2$ was fed to the steam oven and the laminate was heat-treated at 132° C. for 10 min.

Steam in the oven was evacuated again with a vacuum pump to give a cushion material 100 cm wide, 200 cm long and 10 cm thick having a density of 0.035 g/cm$^3$ in which the webs were melt-adhered into a whole mass in the oven.

The resultant cushion material was cut into 8 sheets each 50 cm square and then cut into three equl parts to the direction of thickness. Distribution of density and hardness, repeated compression and compression set of each portion were measured in accordance with JIS K 6401. The results are shown in Tables 1 and 2 together with the test results for the conventional cushion materials prepared by hot air circulation (Comparative Examples 1 and 2).

From the measured values shown in Tables 1 and 2, it can be found that the cushion material prepared by the method according to the present invention has a hardness and a density focused within a definite range in any portion and is low in compression set and has a uniform excellent quality.

TABLE 1

| | Sample | | Surface hardness | Density (g/cm$^3$) |
|---|---|---|---|---|
| Example | A | Upper layer | 43 | 0.0356 |
| | | Mid. layer | 40 | 0.0352 |
| | | Lower layer | 45 | 0.0353 |
| | C | Upper layer | 42 | 0.0354 |
| | | Mid. layer | 43 | 0.0353 |
| | | Lower layer | 43 | 0.0353 |
| | F | Upper layer | 41 | 0.0355 |
| | | Mid. layer | 40 | 0.0352 |
| | | Lower layer | 43 | 0.0353 |
| | H | Upper layer | 44 | 0.0357 |
| | | Mid. layer | 44 | 0.0354 |
| | | Lower layer | 45 | 0.0355 |
| Comparative | 1 | Upper layer | 34 | 0.0254 |
| | | Lower layer | 48 | 0.0386 |

TABLE 1-continued

| Sample | | | Surface hardness | Density (g/cm³) |
|---|---|---|---|---|
| Example | 2 | Upper layer | 35 | 0.0271 |
| | | Lower layer | 52 | 0.0405 |

*1) The designations A to H for the samples in Examples their positions when the cushion material of 200 cm long was cut into two portions in the width direction and four portions in the length direction to give samples of 50 cm square. The relationship between them are as follows

A B C D

E F G H

*2) In Comparative Examples, the samples having a thickness of 33 mm were sliced to half thickness and their densities were measured. The hardness was measured at the upper surface and the sliced surface.

TABLE 2

| Sample | | Compression test: Compression hardness (kgf/cm²) | Compression set (%) | Repeated compression set (%) | Resilience (%) |
|---|---|---|---|---|---|
| Example | B | 0.065 | 9.6 | 6.5 | 57 |
| | D | 0.062 | 9.4 | 6.5 | 55 |
| | E | 0.063 | 9.4 | 6.6 | 57 |
| | G | 0.066 | 9.7 | 6.4 | 58 |
| Comp. Ex. | 1 | 0.058 | 15.6 | 16.8 | 33 |
| | 2 | 0.053 | 17.4 | 18.3 | 34 |

*1) The designations for samples in Examples are same as in Table 1.

*2) In Comparative Examples, the test was carried out by piling up three sheets of the sample having a thickness of 33 mm.

TEST METHOD

1. Surface Hardness

Nine positions were measured by using a F type hardness meter and their average is shown.

2. Density

The volume and the weight of the sample were measured and the density was calculated by the following equation.

$$D = \frac{W}{V}$$

where

D: Apparent density (g/cm³)

W: Sample weight (g)

V: Sample volume (cm³)

3. Compression Hardness (in accordance with JIS K 6401)

A sample of 150×150 mm was placed between two parallel compression plates and compressed to 0.36 kgf at a rate of not higher than 10 mm/sec. and the thickness at that time was measured to give the initial thickness and then the sample was further compressed to 25% of the initial thickness and stood for 20 sec. and the load was read to give the hardness.

4. Compression Set

A sample of 150×150 mm was placed between two parallel compression plates and compressed to 50% of the initial thickness and fixed and then stood at room temperature for 40 hours and then the compression plates were removed and the sample was stood for 30 min. and the thickness was measured.

$$C = \frac{t_0 - t_1}{t_0} \times 100$$

where

C: Compression set (%)

$t_0$: Initial thickness of the sample (mm)

$t_1$: Thickness of the sample after the test (mm)

5. Repeated Compression Set

A sample of 150×150 mm was placed between two parallel compression plates and repeatedly compressed for 80,000 times to 50% of the sample thickness at room temperature at a rate of 60 times per min. and then the sample was removed and stood for 30 min. and the thickness was measured and the set was calculated by the same equation as in the above 4.

6. Resilience (JIS K 6401-1980)

A sample speciment of a side of not less than 100 mm and a thickness of not less than 50 mm was placed on a horizontal platform and a $\frac{5}{8}$ common steel ball specified in JIS B 1501 (Steel ball for ball bearing) was freely dropped from the height of 460 mm over the surface of the sample onto it and the resilient height was measured. The test was repeated on the different three or more sites of the sample and the average value was shown.

$$R = \frac{D_1}{D_0} \times 100$$

where

R: Resilience (%)

$D_1$: Drop distance 460 (mm)

$D_0$: Resilient height (mm)

EXAMPLE 2.

(A) 75 weight % of regular polyester fibers (fineness: 15 denier, cut length: 64 mm, melting point: 257° C.) and (B) 25 weight % of core-sheath type conjugated fibers (fineness: 3 denier, cut length: 51 mm) containing a polyethylene terephthalate having a melting point of 257° C. as the core and a copolymerized polyester (terephthalic acid/isophthalic acid=60/40) having a melting point of 110° C. as the sheath were mixed and carded. Then the obtained webs were laiminated and molded in the same manner as in Example 1 to give laminates having a density of 0.01 g/cm³ to 0.04 g/cm³ as shown in Table 3.

The flame resistance of the laminates was measured by a method according to the standard test for flame-retarded products in Japan Flame Retardant Association. The results are shown in Table 3.

TABLE 3

| | density (g/cm³) | maximum carbonized length (mm) | average carbonized length (mm) | judgement |
|---|---|---|---|---|
| Example 2 | 0.01 | 90 | 79 | acceptable |
| | 0.02 | 85 | 79 | acceptable |
| | 0.03 | 80 | 74 | acceptable |
| | 0.04 | 72 | 69 | acceptable |
| Comp. Ex. | 0.01 | 113 | 105 | acceptable |
| | 0.03 | 96 | 92 | acceptable |

*1) In Comparative Examples, the test was carried out by piling up three sheets of the sample having a thickness of 33 mm.

EXAMPLE 3

(A) 50 weight % of hollow conjugated polyester fibers having a hollowness of 16.4% (fineness: 13 denier, cut length: 51 mm) prepared by conjugating side by side a polyethylene terephthalate having a relative viscosity of 1.37 and a polyethylene terephthalate having a relative viscosity of 1.22 in a ratio of 1:1 and 32 weight % of disinfecting hollow fibers (fineness: 13 denier, cut length: 64 mm) consisting of polyethylene terephthalate compounded with metal ion comprising zeolite solid perticles which have antibacterial properties, and 18 weight % of core-sheath type conjugated binder fibers (fineness: 3 denier, cut length: 51 mm) were mixed and carded according to the general method. With the resultant web, a cushoning material having a width of 100 cm, a length of 200 cm, a thickness of 10 cm and a density of 0.035 g/cm$^2$ was obtained in the same manner as in Example 1.

The antibacterial activity of the cushoning material was measured with use of a germ, Klebsiella pueumeniae, by Shake Flask Method recited in Sanitary Finishing Conference for Textures. The results are shown in Table 4.

TABLE 4

| Sample | | anti-bacterial fiber | density (g/cm$^3$) | colony number before shaking | colony number after shaking | decreasing ratio of the germ |
|---|---|---|---|---|---|---|
| Example | Upper layer | 32% | 0.035 | $2.0 \times 10^4$ | 300 | 98.5% |
| | Mid. layer | | | | 140 | 99.3% |
| | Lower layer | | | | 240 | 98.8% |
| Comparative Example | | — | 0.035 | $2.0 \times 10^4$ | $1.8 \times 10^4$ | 10.0% |
| Blank Test | | — | | $2.0 \times 10^4$ | $2.0 \times 10^4$ | 0% |

As described above, the present invention can provide a cushion material of high quality, which has a uniform density and a very low compression set regardless of thickness.

What is claimed is:

1. A cushion material prepared from a mixture comprising polyester fibers (A) having a fineness of 4 to 30 denier and a cut length of 25 to 150 mm and core-sheath type conjugated fibers (B) having a fineness of 2 to 20 denier and a cut length of 25 to 76 mm in a weight ratio of 95~40:5~60, the sheath component of said conjugated fibers having a melting point lower than that of the core component of said conjugated fibers and said polyester fibers with a difference of 30° C. or more, cubically and continuously interconnected portions of said fibers being adhered by fusion of the sheath portion of said core-sheath type conjugated fibers, said cushion material having a thickness of at least 10 mm and a uniform density of 0.003~0.15 g/cm$^3$, the scattering of said density being not wider than ±5%.

2. A cushion material as defined in claim 1, said (A) polyester fibers are side-by-side type conjugated fibers consisting of two polymers having a difference in heat shrinkage.

3. A cushion material as defined in claim 1, wherein said mixture further comprises antibacterial fibers.

* * * * *